US011840861B1

(12) United States Patent
Harper

(10) Patent No.: US 11,840,861 B1
(45) Date of Patent: Dec. 12, 2023

(54) SELECTIVELY SECURABLE, MAGNETICALLY ATTACHABLE AND REMOVABLE, FOOT ACTIVATED DOORWAY OPENER, PREFERABLY FOR HORIZONTALLY SLIDING SCREEN DOORS

(71) Applicant: Theresa Harper, Franklin, ME (US)

(72) Inventor: Theresa Harper, Franklin, ME (US)

( * ) Notice: Subject to any disclaimer, the term of this patent is extended or adjusted under 35 U.S.C. 154(b) by 26 days.

(21) Appl. No.: 17/734,946

(22) Filed: May 2, 2022

(51) Int. Cl.
*E05B 1/00* (2006.01)
*E05B 53/00* (2006.01)

(52) U.S. Cl.
CPC ..... *E05B 1/0015* (2013.01); *E05B 1/0053* (2013.01); *E05B 53/001* (2013.01)

(58) Field of Classification Search
CPC ..... E05B 1/0015; E05B 1/0053
USPC ..... 16/412, 413, 414
See application file for complete search history.

(56) References Cited

U.S. PATENT DOCUMENTS 3,524,215 A * 8/1970 Kurtz ..... E05B 1/0015 16/443
4,805,263 A * 2/1989 Kurtz ..... E05B 1/0015 16/443
5,159,739 A * 11/1992 Adinolfi ..... A47B 88/57 16/415
5,927,018 A * 7/1999 Thain ..... E05B 53/001 49/460
6,067,690 A * 5/2000 Herman ..... E05B 53/001 292/342
6,842,946 B2 * 1/2005 Hayden ..... E05B 1/0015 403/DIG. 1
7,246,413 B2 * 7/2007 Portelli ..... A47B 95/02 16/441
8,360,488 B2 * 1/2013 Forrest ..... E05B 1/0015 292/355
8,752,334 B1 * 6/2014 Vanduch ..... E05B 17/0033 49/70
8,918,962 B2 * 12/2014 Schrader ..... E05B 1/0015 16/412
9,534,419 B2 * 1/2017 Schrader ..... E05B 1/0015
9,714,524 B2 * 7/2017 Parish-Allaire ..... E05B 53/001
D845,752 S * 4/2019 Parish-Allaire ..... D8/404
10,494,834 B2 * 12/2019 Schrader ..... E05B 1/0015
11,572,705 B2 * 2/2023 Roberts ..... A61L 2/238
11,719,018 B2 * 8/2023 Amante ..... E05B 1/0015 49/460

(Continued)

FOREIGN PATENT DOCUMENTS

GB 2593233 A * 9/2021 ..... E05B 1/00

*Primary Examiner* — Jeffrey O'Brien
(74) *Attorney, Agent, or Firm* — Andrew S. Langsam; Law Office of Andrew S. Langsam, PLLC

(57) ABSTRACT

A pair of foot-contacting components are magnetically coupled on both sides of the bottom frame of a corner of a sliding screen door. The magnetic coupling holds the components to one another about the frame and near to the door's lower corner. The components have foot or toe contact surfaces so that either component can be contacted by a foot or toe in such a manner that lateral movement of the user's foot or toe against the component will slide the door open or closed in its trackway. The components are shaped to facilitate contact with the user's toe/foot and are easy to put onto the door and selectively removed. The magnets are molded into components (preferably made of silicone, rubber, hard plastic, etc.) and can be quickly placed onto the door and removed.

6 Claims, 11 Drawing Sheets

(56) References Cited

U.S. PATENT DOCUMENTS

| | | | | |
|---|---|---|---|---|
| 2004/0078933 | A1* | 4/2004 | Forrest | E05B 1/0015 16/417 |
| 2004/0261226 | A1* | 12/2004 | Moody | E05B 53/001 16/413 |
| 2005/0005402 | A1* | 1/2005 | Moody | E05B 53/001 16/413 |
| 2007/0069090 | A1* | 3/2007 | Driscoll | E05B 1/0015 248/206.5 |
| 2016/0230415 | A1* | 8/2016 | Parish-Allaire | E05B 15/1607 |
| 2016/0340929 | A1* | 11/2016 | Gagnon | E05B 1/0015 |
| 2021/0254384 | A1* | 8/2021 | Kelley | E06B 3/485 |
| 2022/0154489 | A1* | 5/2022 | Connell | E05B 53/001 |

* cited by examiner

SELECTIVELY SECURABLE, MAGNETICALLY ATTACHABLE AND REMOVABLE, FOOT ACTIVATED DOORWAY OPENER, PREFERABLY FOR HORIZONTALLY SLIDING SCREEN DOORS

BACKGROUND OF THE INVENTION

The present invention relates to a non-permanent, i.e., selectively attachable and easily removable pair of magnetic protrusions which when magnetically attached to one another on the two sides of the bottom frame near the corner of a sliding door, aid in the hands-free or foot operation of the sliding open and closing of the screen door. Likely, that screen door is a simple screen for a doorway between the outside of a home and the inside. Preferably the horizontally sliding screen door is a screened patio door held in a guideway and is usually opened and closed by a simple handle on one end of the door Use of the present invention allows the sliding screen door to open and close by use of one's foot, allowing the user's hands to hold other objects/things.

The two protrusions to be attached to the bottom frame approximately three inches from the corner of the screen door (one on the inside of the screen door, the other on the outside of the same place of the same door) are magnetically attachable to one another. They will be located on the two opposed sides of the bottom frame of a sliding screen (or it could be a solid sliding door). The placement is located approximately three inches above the bottom corner of the frame but generally directly below that edge of the door where the handle is located. As an example, the screen door connects between an interior room (like a kitchen or den) of a home and an outside patio, deck or porch. Installation of the protrusions is quick, easy and secure by merely locating one of the two mirror halves of the device on the frame approximately three inches from the corner of one side of the sliding screen door and then the other half (the second protrusion) is located on the opposite side of the same bottom frame of the same sliding screen door. The two components are provided with interior located, magnetically attracting components (north and south poles, for example, of bar or other magnets which attract one another) so that when they are aligned, at the frame near the bottom or corner of the slidable screen door, they will magnetically attract and "adhere" to one another with the sliding door frame between them.

When a user seeks to pass from inside of the home to outside or vice versa, i.e. through the closed portion defined by the screen door opening, especially if they have their hands full (with plates, glasses, food, etc.) the user can use his/her toes of the foot or shoe to contact the nearer protrusion and its slanted foot contact surface to slide it laterally (and carry with it the screen door) so as to open the passageway in a hands-free manner. Closing the sliding door is done in the same manner, i.e., contact of the front edge or toes of the foot or shoe with the other or opposed foot contact surface of the same component or on the foot contact surface of the other half of the device, all to simply slide the screen door in its trackway to either open or close the door, opening or closing the opening. Since both sides of the sliding screen door each are provided with a half of the overall device, the movement of one's foot pressed onto the foot contact surface of the protrusion will result in the door being easily slid open and closed within the trackway or guide, all by only using one's foot, not either of the hands. This makes opening and closing easy and thus does not require the user to put down the carried items and then grasp the handle to laterally slide the door. The device, i.e., the two halves which are magnetically secured on the two sides of the frame of the screen door when operation of the same is desired, can be removed when no longer in active use, for example, over the winter months, if desired, by merely magnetically uncoupling the two halves by pulling them apart (or twisting and pulling) and overcoming the magnetically attractive forces between the two, opposed foot-contacting protrusions.

According to one embodiment of the present invention, the protrusions, which are mirror images of one another, are made of a hard plastic, formed from simple molded components, magnetic bars, and simple hardware. Another embodiment contemplates the use of hard plastic but in this version the shape of the foot contact surface is of a different shape to facilitate ease of placement on the screen door and decoupling the magnetic attractive forces of the two components when removal is desired. And, a third embodiment is provided which is made of a rubber-like material or molded silicone which is formed with an easy to grip pair of surfaces which make the twisting of the protrusion easy and convenient by a simply grasping of the same with one's hand, in a manner similar to turning a handle. One of the latter embodiments visually resembles a "Y" and another embodiment of the silicone version visually resembles an "M" configuration.

DESCRIPTION OF THE PRIOR ART

Sliding doors, including sliding screen doors, often are used in the rear of a home to connect a kitchen to an outdoor patio or deck. These screen doors are often associated with sliding glass doors and travel in guideways, secured to the top and bottom surface of the doors. The glass doors and the associated screen doors often connect the inside of a room or home to another area or room—most often an outdoor patio or exterior deck. Residential home owners, restaurants, hotels, venues, etc. use sliding glass doors and associated screen doorways for a variety of reasons. Generally, the door or screen door opens and closes an opening for a person to walk through. The sliding screen door usually slides on and within a trackway when the user (who seeks to pass through the opening after the glass door or screen is moved to the open position) slides the door or screen. When the glass door and the screen door are in the open position, a person can pass through the opening. Handles are provided to facilitate the lateral opening and closing of the slidable screen doors. Often, the sliding screen door is then closed after the user passes through the opening. When the user has his/her hands (or at least one hand) free, i.e., without carrying anything, it is simple to grasp the handle (at about 3-4 feet above the ground) and laterally slide the door or screen in the trackway to the open or closed position. However, when the user has both hands full, with items to be taken outside or back inside the home (carrying food, dishes, refuse, etc.) the sliding of the screen door, even though lightweight compared to the glass doors, can be difficult. It is usually necessary to somehow grab the handle even with only a finger to slide the screen door to the open or closed position (after passing through). The user either has to do the sliding operation with his/her few available and strong finger(s) or the user has to first put down some items to free up at least one hand, use the handle to slide the door into the proper condition (open or closed) and then pick up the items sought to be carried through the opening. Then the screen door needs to be closed on the other side, again, often first requiring the user to first place one or more of the carried items elsewhere to free up a hand or finger(s) to slide the door. This is inefficient and quite frustrating. The open and quick closing is often a consequence of the desire to keep pets in or out and bugs (out), and/or to maintain air conditioning temperatures inside the home. So, clearly, if one could reduce the effort and time to place the carried items down on a surface to open and/or close the screen door, efficiency is maintained, coolness within the home maintained, pets are monitored, blocking of insects from entering the home is more effective, and time is saved. The present invention solves these issues.

The primary manner of opening and closing the screen door now, i.e., before the present invention, is the use of a manual handle, located about waist high, on both sides of the sliding screen door. As mentioned, this is not always convenient. It requires the use of one or the other hand or fingers. The present invention is a simple mechanical pair of foot-slidable devices which magnetically attach to one another with the corner of the bottom frame of a slidable screen door therebetween. These provide foot and toe or front of shoe engaging surfaces to use with a lateral movement of one's leg and foot to slide the screen door open or closed, as desired, without the use of one's hands or fingers. And, the present invention can be easily removed, as desired, and, when removed does not leave visual holes for screws which otherwise could secure the devices to the bottom frame of the sliding screen door. The present invention can be simply attached to the bottom frame of the screen door, without any hardware or tools and just as simply removed.

The present invention eliminates the need to use a free hand or fingers for the sliding of the door or screen. Rather, the present invention provides a simple, non-permanent, magnetic attraction means for providing a foot interactive component to the base and frame of the screen door so that even one with both hands full of items can open and close the door in a minimum of time, just by moving one's toes or foot against a protrusion at the bottom frame of the screen door and laterally moving one's foot or leg. A pair of opposed foot-contacting elements or protrusions, one on each side of the bottom frame of the door or screen, with the elements or protrusions being magnetically attracted to one another and thus held in position on the bottom of the door or screen door, with the magnetic attraction being not to the door (since usually screen doors are made of aluminum) but to one another, is provided. And each protrusion on each side of the screen door has two to three (or multiple) toe or foot-contacting surfaces so that opening or closing of the door from that side of the screen door can be accomplished with ease. Then, when the user wants to slide the door or screen open or closed, he/she can simply, easily, and without hands or fingers, do so by using a foot and/or leg motion to interact with the appropriate surface of the foot-contacting elements of the protrusion and then sliding the door or screen on the trackway by moving his/her foot and leg in the direction sought for the movement of the door or screen door. This can be done for opening and for closing and can be done from either side of the sliding door or screen door.

In addition, if desired, the present invention can be easily and quickly removed, for cleaning, washing, or just for aesthetics, by pulling the foot-contacting elements away from one another (possibly requiring a slight twist of one component relative to the other) so as to overcome the magnetic attraction of the two components. There are no screws to tighten or unscrew in the assembly or removal operation, no holes to be drilled into and/or through the door or screen door. The two magnetic mating components, one on each side of the base about three inches from the bottom corner of the screen door (preferably, although the devices can be secured anywhere along the bottom frame of the screen door) are simply magnetically attached to one another or, when desirably removed, just pulled away from one another by hand. A simple twist of one hand with respect to the other (both hands holding the components, one on each side of the frame of the door) will result in a simple overcoming of the magnetic attraction and thus enables mechanical removal of the device.

The prior art shows foot-activated devices which are secured to the bottom of a sliding door and/or screen door in a mechanical manner (screws or mechanically coupling) and these can be placed onto the door and easily removed but often, when harshly used or even if just contacted by the foot, seem to decouple from the door. Or, in the case of screws, the foot-opening devices cannot be quickly removed and, in any event, require a tool for removal and then the door shows holes where the screws were located. This can be aesthetically unacceptable. Another piece of seemingly prior art shows two screens attached vertically with a magnetic strip. This design allows pets to escape. This design is also prone to moving erratically and knocking off tall glasses from serving trays. There is also available a mechanism with counterweights and pulleys for operating the opening and closing of a screen door. All such mechanisms have certain disadvantages compared to the present invention.

The present invention, by using magnetic attraction sufficient so that each of the two components couple to one another, reduces if not eliminates the risk of unintended or accidental removal. And the present invention allows for quick removal. The present invention couples to a variety of sliding doors and screen doors because the components couple to one another, not mechanically to the geometry, material, nor dimensions of the door (except for thickness) but to the opposing magnetic forces of the two components, one on each side of the frame of the door. And the present invention couples and holds to the door or screen door even if and when the doors are made from non-ferromagnetic material, e.g., light-weight aluminum (as is common in sliding screen doors). Rather, the two components (one foot contact element is located on each side of the sliding screen door) are magnetically attracted to one another, not held to the door but, on the two sides of the frame of the door or sliding screen door.

The prior art shows automatic opening of doors and closing behind one's passage through the door by using various electro-mechanical elements, infra-red sensors, motion detectors, and electric eyes all with motors, pulleys or levers which when a person approaches the door, the sensors detect approaching movement and open and close the door. These are expensive and need maintenance. The prior art also shows a touch sensitive activating pad for doors, but these, too, are sophisticated, expensive and require maintenance. The sensors or touch sensitive devices operate a motor for opening then reclosing the screen or glass door. Clearly, that set of components can suffer from mechanical and electrical problems. They are expensive to install and difficult to disassemble quickly. And in any event, the installation and cost of the same are far more expensive than that contemplated by the present invention.

SUMMARY OF THE INVENTION

The present invention comprises an opposed pair of fronts of foot or toes-contacting components which magnetically attract and hold to one another about the two sides of the bottom frame near the corner of a sliding glass or screen door. The components are intended to be small and unobtrusive but, due to the magnetic forces between the components, they are securely held in place, even with a frame of a screen door and its thickness held therebetween. The shape of the components is made such that its back is flat against the frame of the door, with each side edge thereof provided with a simple slanted or curved surface to interact with one or more toes of a foot or a shoe or the entire front side (even a heel) of a foot. In this manner, when a person approaches a closed door which is equipped with the components, he/she can move their toes, shoe, or foot into contact with the slanted/curved surface of the component and then laterally move his/her foot and leg to one side for movement and lateral sliding of the door within its trackway. The door will thus open and close as the foot, toes and/or leg movement contacts and interacts with the side surface of the foot-contacting component and causes it to move. Since the components are firmly held to the door or screen and magnetically to one another through the thickness of the frame of the door upon which they are located, they will not move with respect to the door or screen door but rather the door will move and slide in the trackway in the direction of movement of the foot, toes, and/or leg. In this manner the door can be opened and/or closed without the use of one's hands. And of course, by using two mating components, magnetically attracted to one another about the thickness of the frame of the sliding door and/or screen door, the doorway can be opened and closed from both sides, as desired.

According to the embodiments disclosed of the invention, a set of the components (which magnetically attract to one another about the frame of the screen door) can be made from extruded hard plastic forming an interior chamber which fit together with a strong magnet contained therein. The other magnetically attractive magnet will be held within the chamber of a second hard plastic component with its own interior chamber. These can be placed onto a screen door on the two opposed sides thereof and magnetic attraction will hold them in place for use.

Another embodiment of the invention also uses hard molded or plastic extruded components which together form an interior chamber for a bar magnet which magnetically couples to another bar magnet in the paired component but in this embodiment the foot or toe contacting surfaces and the overall form is sleeker than in the first set of components and thus the handle formed between the foot or toe-contacting surfaces provide an easier manner for assembly and disassembly on the door in that the sleeker components provide a superior grip for a hand than the other version. The securement of the handle of each component slightly differs (one set has a wider securement to the magnet-holding cavity or compartment than the other) and this aids in the assembly and removal of the components to the door.

Another embodiment of the present invention also has mating components each of which is formed from molded silicone with an interior-located magnet. It has, of course, advantages, (no assembly by the manufacturer is required with a magnet held within two halves of hard plastic between which a cavity is formed) and disadvantages (cost and aesthetics). This version can be provided with LEDs to help locate the components in the dark, as can the other embodiments. Alternatively, the housings or the molded silicone can be provided with glow-in-the-dark materials.

The magnets used are preferably strong and sized for the thickness of the door they are secured to and the material into which they are housed. The magnets need to be held within a protective casing as those of sufficient strength and yet small size tend to be brittle and can shatter if not provided with a protective casing. Also, the strength of the magnets holding the two components to one another is such that they should not be capable of being pulled apart and off the screen door by children nor accidentally falling off during use or nonuse. The magnets should also not be so small as to be capable of being accidentally swallowed by children. Yet, the magnets, within the protective housings, I.e., within the interior cavities of the components, whether made of silicone, or other hard plastic material, need to be able to be easily and securely coupled and then easily decoupled from one another. The latter is accomplished by having both of the opposed components in a shape which is easy to twist by hand to uncouple the magnets and yet by using strong magnets which have high strength of attraction in a direction towards one another but which the magnetic attraction drops off rapidly once one component is twisted or turned with respect to the other component. This allows the two components to be removed from one another and from the door, when and as desired.

The components can be made by encasing strong magnets in Silicone or in Hard Plastic components which together form a cavity, and/or in another sturdy material. According to the preferred embodiment of the invention, the components (mirror images of one another and/or merely identical components) have a preferred bottom and flat surface which is elevated above the floor, a rear and flat back surface for contact with the frame of the door, and two opposed and outwardly slanted side surfaces (extending from the plane of the door to the outside edge of the components) which allow the foot, toe(s) or shoe of the user to contact and laterally slide the same. And the top of the components can also be provided with a groove or central notch for possible contact with a toe or foot, also to laterally slide the component to either open or close the screen door.

One of the embodiments which is to be made of hard plastic has a wide-at-the-bottom handle (like a pyramid) for each component while the other hard plastic component is constructed with a narrower-at-the-bottom gripping handle. A combination of the embodiments providing a wide-at-the-bottom horizontal aspect for foot operation and a narrower-at-the-bottom vertical aspect for easy gripping by hand is also plausible and within the scope of the invention. In contrast, the molded silicone set of components, also containing the magnets for attracting one another through the thickness of an aluminum screen door has a centrally-tapered toward the middle section which facilitates the turning of one component relative to the other to facilitate the easy removal of the components from the screen door as the turning decouples the magnets and makes removal of the components rather easy.

One version of the device molded from silicone resembles a "Y" and another an "M."

DETAILED DESCRIPTION OF THE DRAWINGS AND THE PREFERRED EMBODIMENTS

Figure 6:
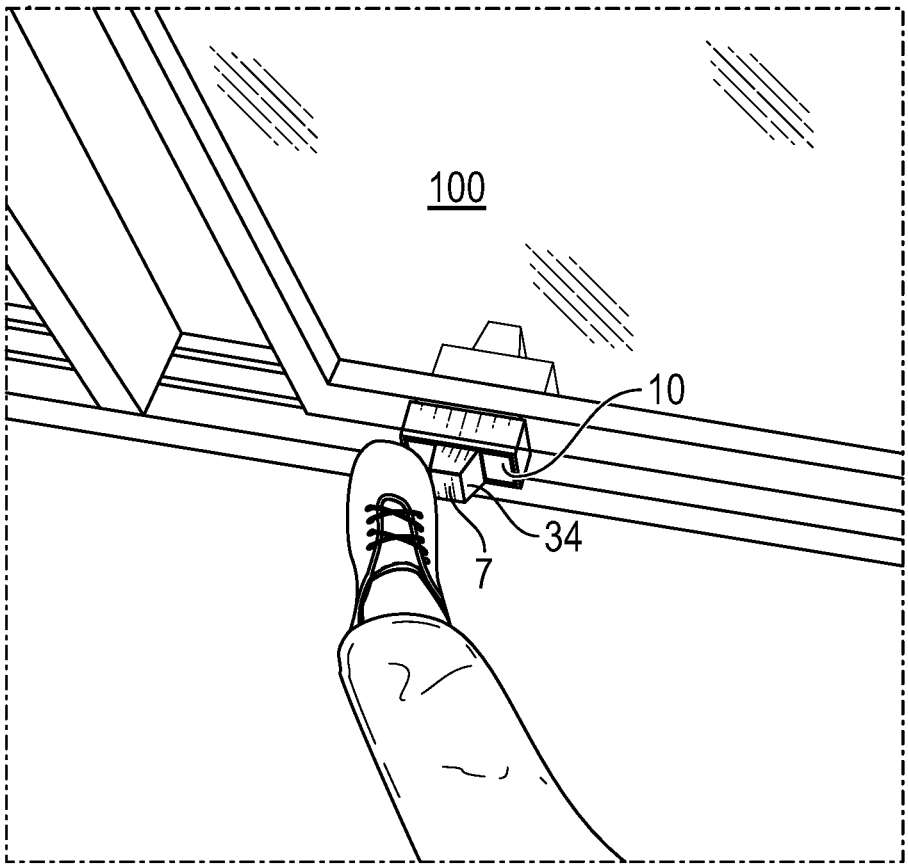
FIG. 6 is a top perspective view of two components shown in FIGS. 1-5, magnetically secured to one another on opposed sides of the frame of a sliding screen door, with a foot of a user being moved by his/her leg to slide the door so as to open the door.
Figure 7:
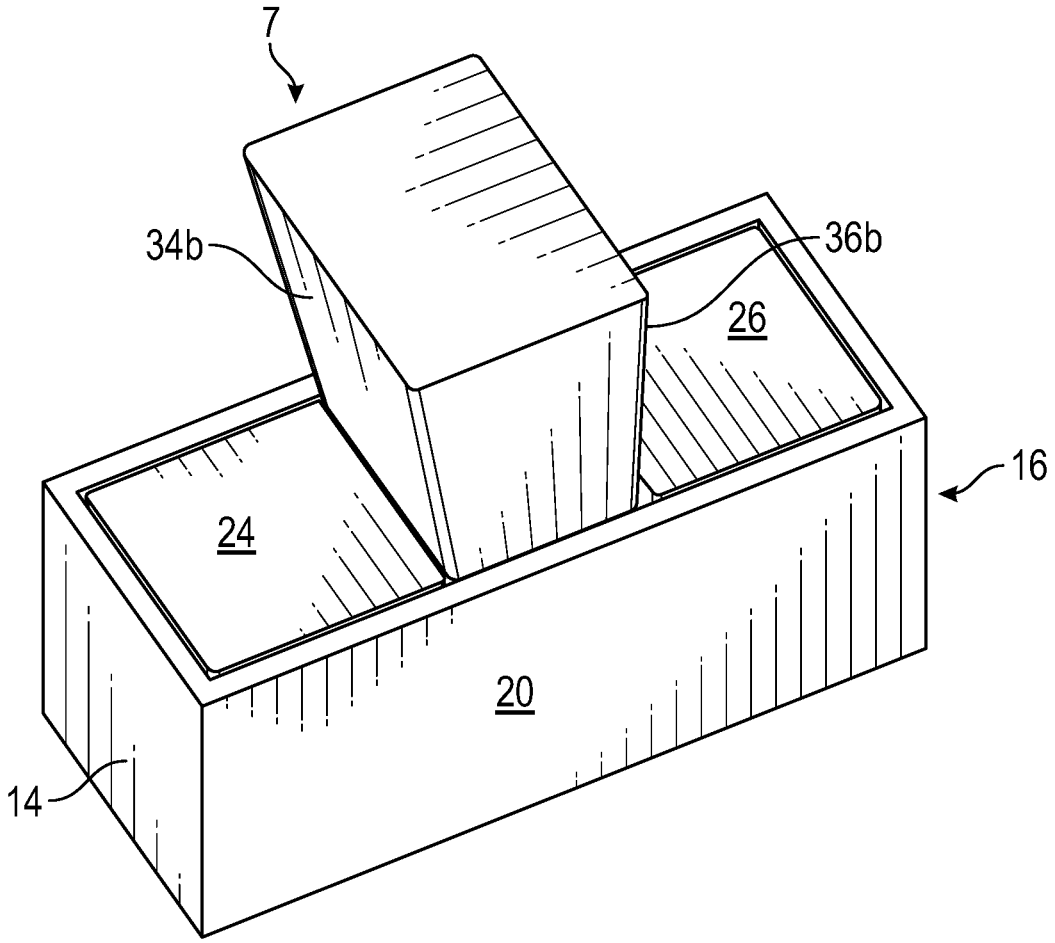
FIG. 7 is a top perspective view of one of the identical two components of a second embodiment which magnetically mates to another about the bottom frame near the corner of a screen door. The components contain magnets which have their polarity arranged within the opposed components so as to magnetically attract to one another with the bottom frame near the corner of the screen door therebetween.
Figure 8:
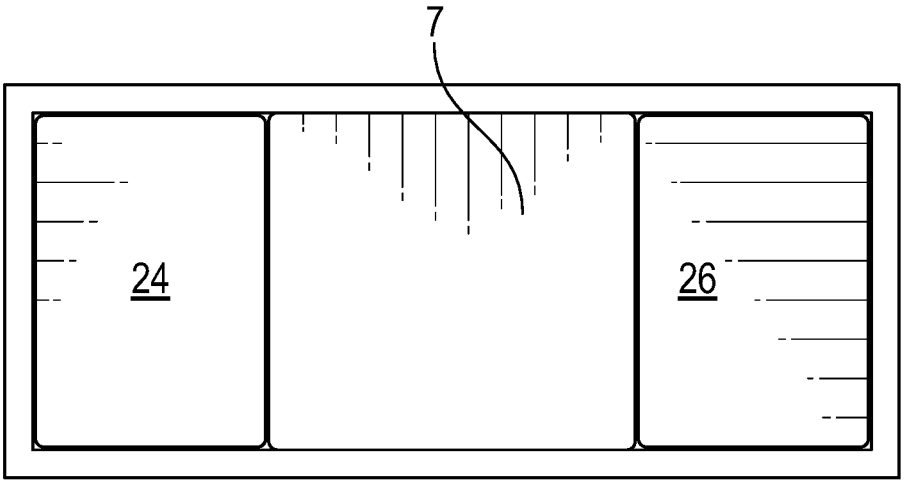
FIG. 8 is a front view of the component shown in FIG. 7.
Figure 9:
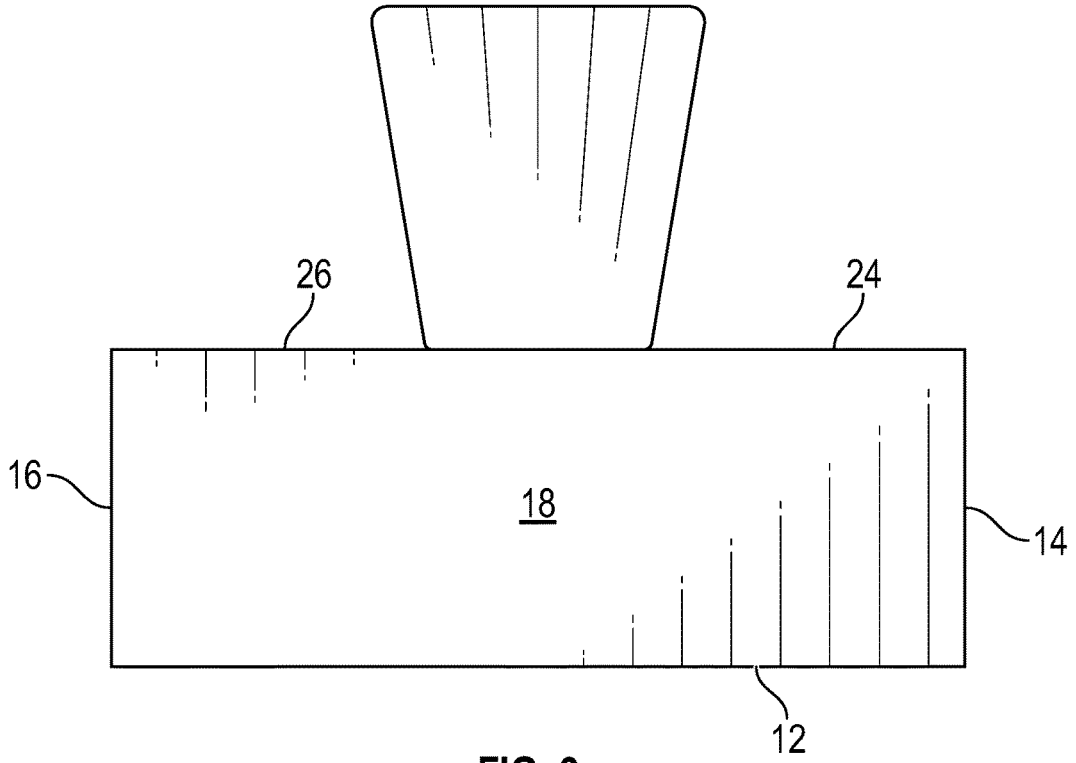
FIG. 9 is a top view of the component shown in FIGS. 7 and 8.
Figure 10:
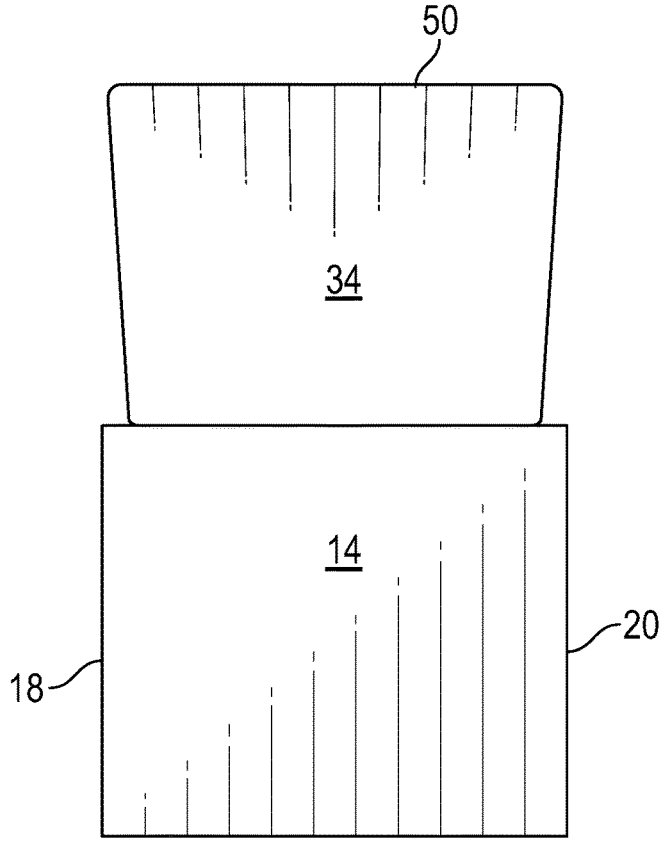
FIG. 10 is a side view of the component shown in FIGS. 7, 8, and 9, with the other side being a mirror image.
Figure 11:
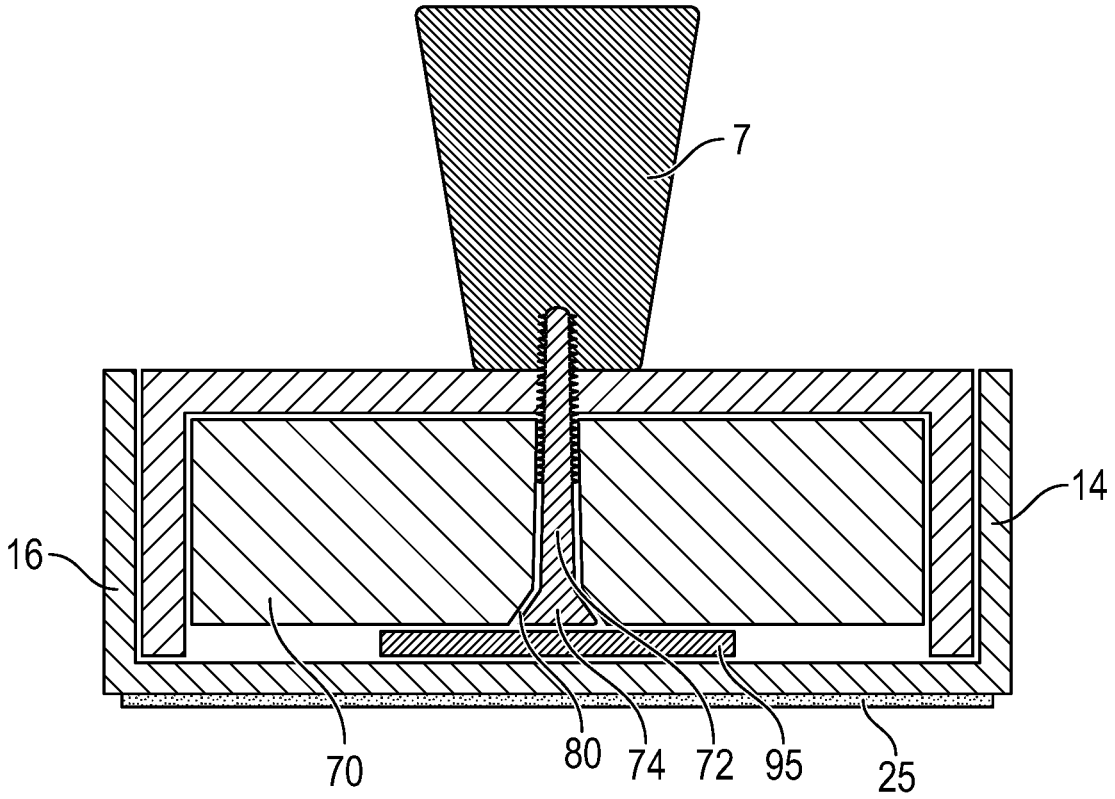
FIG. 11 is a cross sectional view of the interior of the component shown in FIGS. 7-10, similar to that shown in FIG. 5 (but with a different handle and slope of the foot contact surfaces), showing the interior cavity formed with a magnet and other pieces contributing to the manufacture of one of the mating components of the device.
Figure 12:
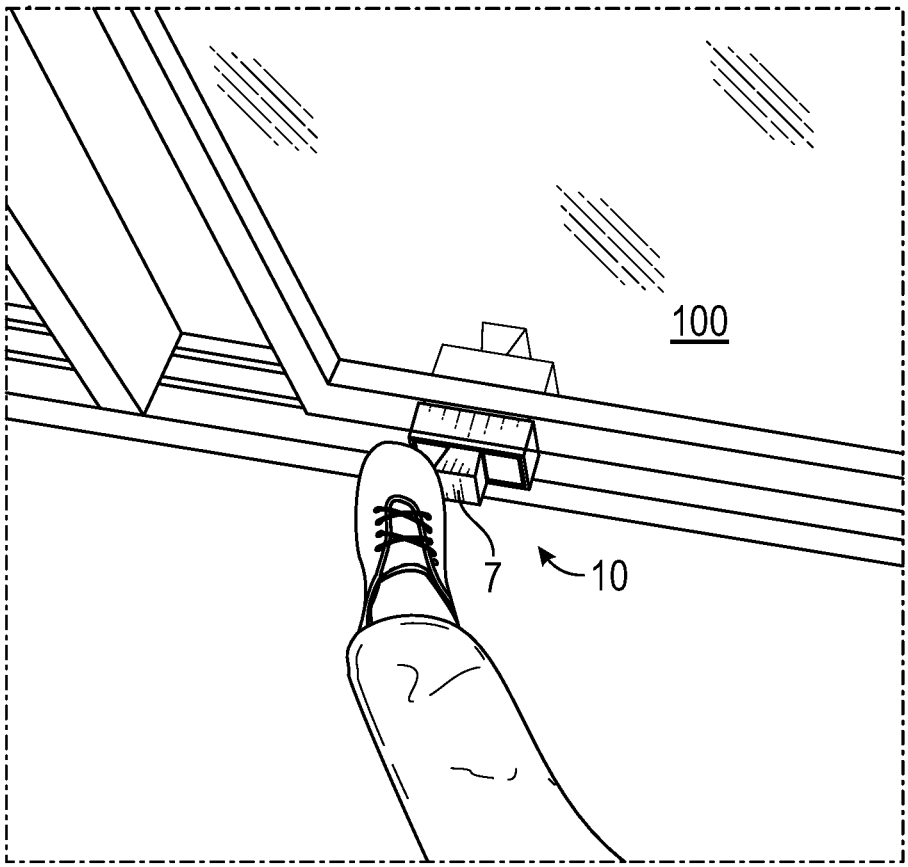
FIG. 12 is a top perspective view of two identical components, one of which is shown in FIGS. 7-11 and shows them magnetically secured to one another on opposed sides of the bottom frame near the corner of the sliding screen door with a foot or the toes of a user being moved against the foot contacting surface of one component to laterally slide and open the sliding screen door.

As shown in FIGS. 1 through 4, a component 10 is shown which is preferably made of a hard, thin-walled plastic molding or extrusion process. Alternatively, as will be described, the product 10 is made from molded silicone. This single component 10 is one of two such components that magnetically mate or couple with one another with the bottom frame near the corner of a sliding screen door held therebetween (as seen in FIGS. 6 and 12). The two components 10 are physically and magnetically identical to one another so that when placed on opposed sides of the screen door, the North Pole of the magnet on the interior side of the door of one component couples to the South Pole of the component on the opposed exterior side of the door. Thus, with N-S and S-N magnetic pole attraction of the bar magnets housed within two of the components 10, the two components 10 are secured about the bottom frame near the corner of the screen door and magnetically to one another. This is shown in FIGS. 6 and 12. If, upon initial assembly about the corner of the aluminum screen door, the two components repel one another, the user can simply flip either of the components over so that the contained magnets attract, as opposed polarity attract one another. In this manner the two components will be held to the bottom frame near the corner of a slidable screen door, just a few inches or so from the corner nearest to the door jamb and just above floor level. A handle with side surfaces which also serve as the foot or toe contact surface is provided to facilitate opening and closing the door without the use of hands. The handle is referred to as element 7 (see FIGS. 6 and 12).

Figure 1:
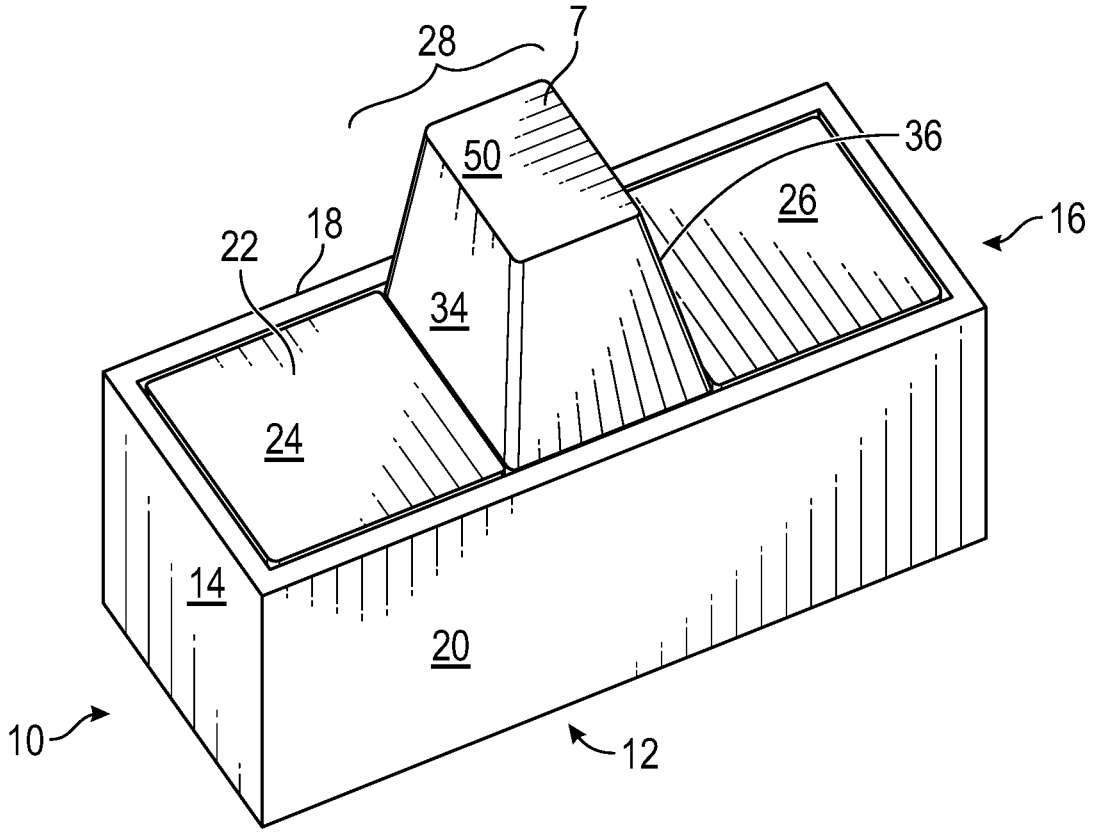
FIG. 1 is a front and bottom perspective view of one of the identical two components which mate to one another about the bottom frame near the corner of a screen door. The components contain bar magnets extending along the flat backs of the components. The magnets have their polarity arranged within the components so as to magnetically attract to one another with the bottom frame near the corner of the screen door therebetween.
Figure 2:
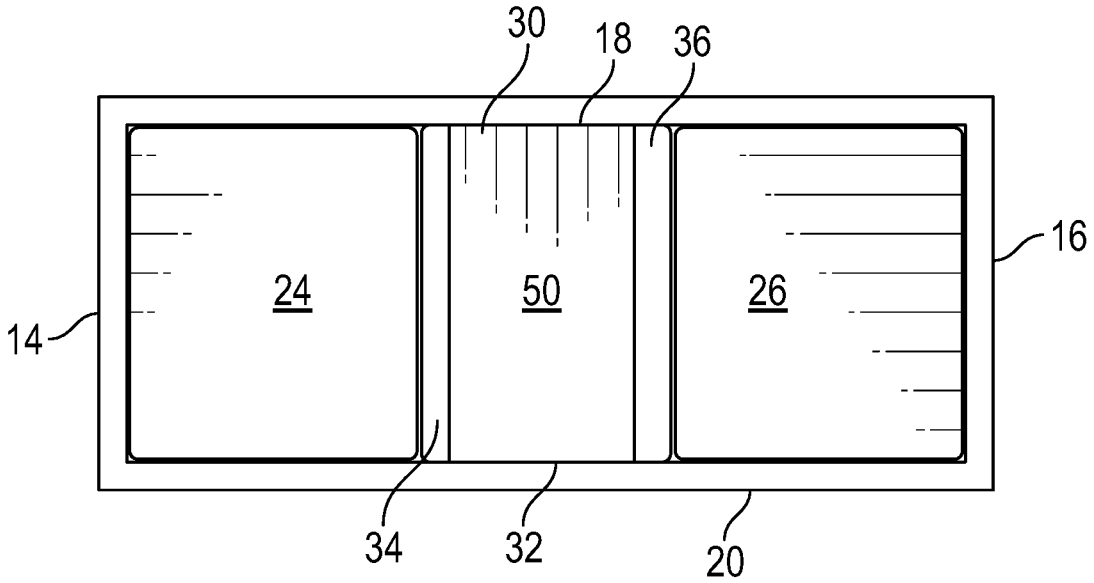
FIG. 2 is a front view of the component shown in FIG. 1.
Figure 3:
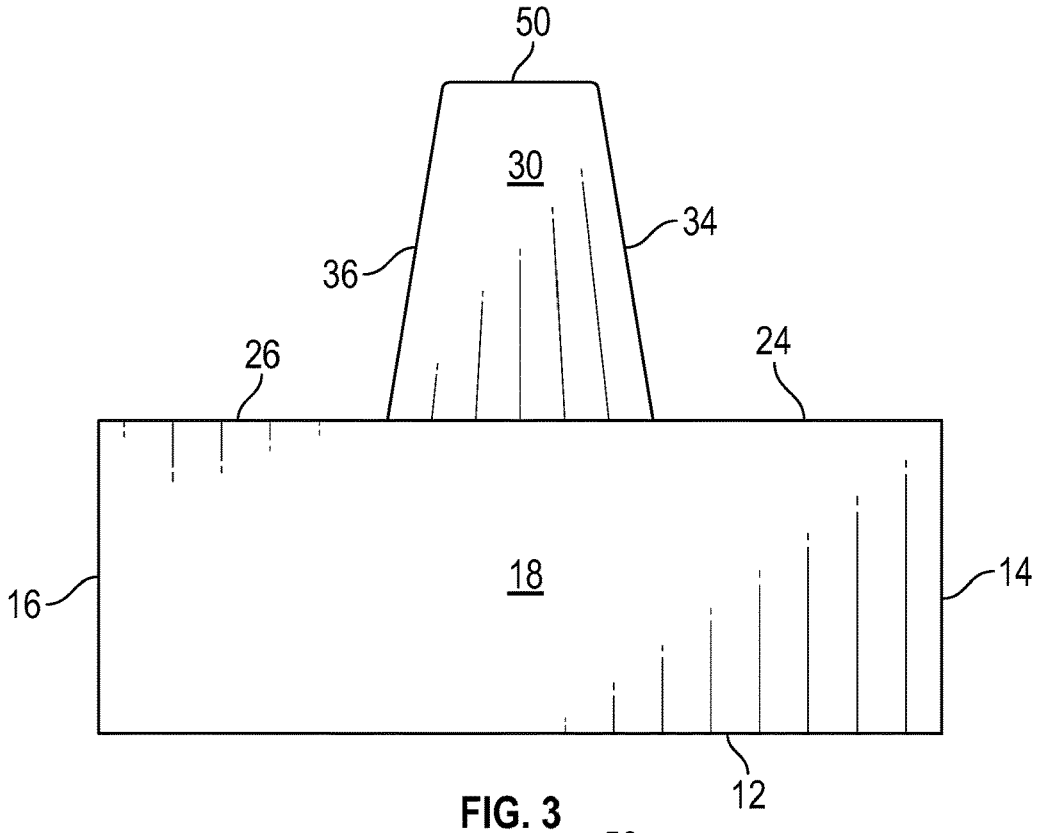
FIG. 3 is a top view of the component shown in FIGS. 1 and 2.
Figure 4:
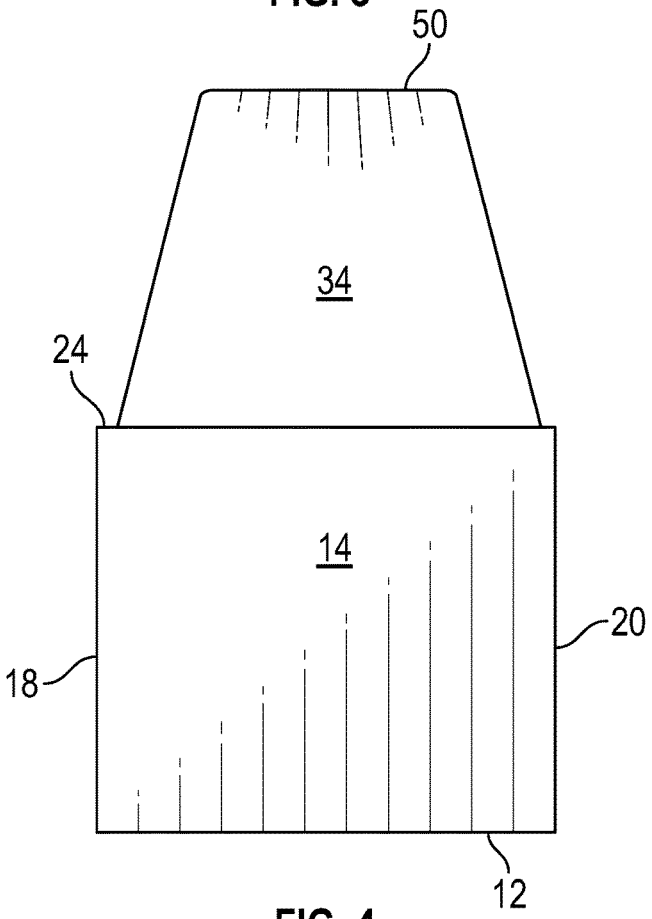
FIG. 4 is a side view of the component shown in FIGS. 1, 2, and 3, with the other side being a mirror image thereof.

The component 10 shown in FIG. 1 has a flat back surface 12 which bears against the frame of the door. The component 10 contains a bar magnet extending from side to side, just inside of the back surface 12. Two opposed side surfaces 14, and 16, a top surface 18 and a bottom surface 20 are provided. The front 22 is segmented into two planar surfaces 24 and 26 and a central toe or foot contact member 28 between the planar surfaces 24 and 26. The toe or foot contact member 28 has a top 30, an opposed bottom 32 (which is parallel to the plane of top surface 30 and to bottom surface 20 but slightly upwardly indented therefrom), and two upwardly and inwardly (or outwardly as in the embodiment of FIGS. 7-11) slanted toe or foot contact surfaces 34 and 36. The bottom 32 of the toe or foot contact member 28 is upwardly recessed from the bottom surface 20, toward top surface 18 as the top 30 of foot contact member 28 is slightly downwardly recessed from the top surface 18. The pair of opposed toe contacts 34 and 36 (of the FIG. 1 embodiment) gently upwardly and inwardly taper from surfaces 24 and 26, respectively, to the small front piece 50. Front piece 50 is parallel to the back surface 12. Top and bottom surfaces 30 and 32, respectively, of the toe or foot contact member 28, are parallel to top surface 18 and bottom surface 20.

Figure 5:
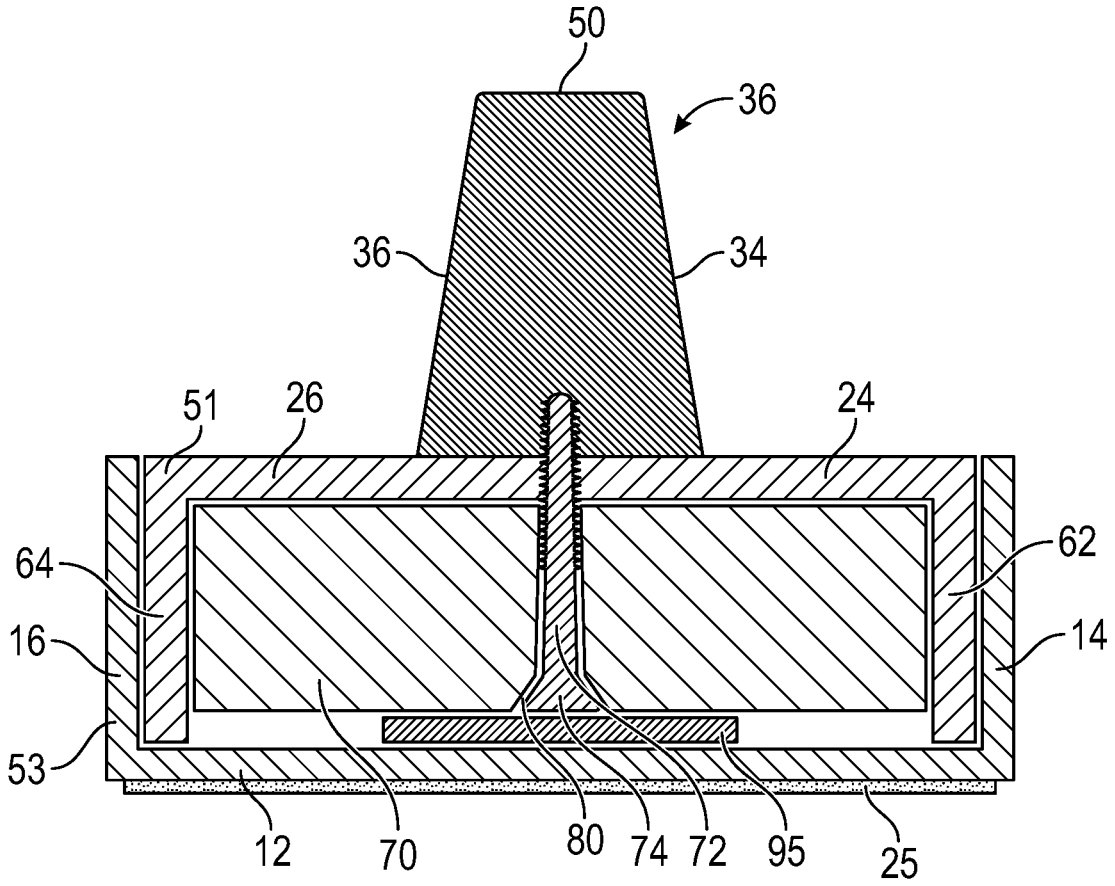
FIG. 5 is a cross sectional view of the interior of the component shown in FIG. 3, showing the interior cavity formed with a bar magnet and other pieces contributing to the manufacture of one of the mating components of the device.

Turning attention to FIG. 5, the pieces that form the component 10 are shown in cross-section. The components 10 can be made of molded silicone or extruded hard plastic or another durable material. Preferably, when made of hard plastic, the component is made of two pieces with one piece forming an open-to-the-front cavity and the other piece forming a rearwardly-opened insert or covering. Together the two pieces form a cavity. The two pieces are dimensionally configured so that the rearwardly open element 51 slides into and within the forwardly open cavity-like element 53 to together form a closed cavity between the pieces 51 and 53. The cavity will house the internally-located bar magnet.

In this embodiment, the sides 14 and 16 and the back 12 along with the top and bottom, 18 and 20, are formed as an open cavity 53 with those identified elements as thin hard plastic walls. A layer of foam or soft material 25 can be adhered or otherwise secured to the back 12. This layer 25 is meant to protect the sliding screen door from damage when the component(s) are secured about the bottom frame near the corner of the aluminum, enamel-painted screen door. An inside (and smaller dimensioned), open towards the rear, box shape is formed from interior side walls 62, 64, and interior top and bottom walls 66 and 68, the latter two not being shown in the cross-section. Top surfaces 24 and 26 ae formed with the rest of the inside open towards the back cavity piece. Clearly, the rearwardly open and dimensionally smaller open box shape defined by walls 62, 64, 66 and 68 fits within the open to the front and dimensionally larger open box defined by walls 14, 16, 18 and 20. The top surface 18 of the combined two pieces, each formed from extruded or molded hard plastic, is the top surface of component 10.

A bar magnet 70 extends between the side walls 14 and 16 and is housed within the inside of the cavity defined by the walls of the component 10. It has, of course, a N and S pole extending outwardly and under the planar surfaces 24 and 26, and will magnetically connect to another component 10 with a similar bar magnet, but with its N and S pole-opposed to the S and N pole of the first component. To magnetically connect, the N of one bar magnet of a first component 10 must be opposed to the S of the bar magnet of the second mating component 10, with the frame of the screen door therebetween. Preferably, each of the bar magnets are provided with a central aperture 80 which holds the magnets 70 in place and to a handle 7 or the piece provided with the toe or foot contact surfaces. The magnet 70 within the closed cavity of the component 10 can be drilled with a hole and that aperture 80 provides a location for a screw 72, which has its head 74 countersunk in the aperture 80 and its screw threads extending into the base of the handle 7 or 90, formed of the elements 28, 30, 32 and 34 and 36. That handle 7 can be plastic molded and solid or it can be a wood piece secured to the front of the component 10. In the embodiment shown in FIG. 5, the handle 7 can be hard plastic or wooden and the screw threads of screw 72 extend from near the front of the component toward the back of the same. The handle 7 is thus secured to the front surface of the open to the rear cavity or box. An adhesive layer of foam 95 can extend over the head of the screw 72 and toward the sides to secure the assembly and serves to protect the bar magnet. The two open cavities are secured together into a single component with the magnetic bar 70 therein. As mentioned, a protective layer of thin foam 25 can be secured/adhered to the back of the component to protect the screen door from damage.

The primary difference between the embodiment shown in FIGS. 1-5 and 7-11, is the shape of the handle 7 or foot contact surface, referred to as element 28, with that of FIGS. 1-5 showing the handle as more pyramidal (wider at its base) and that of FIGS. 7-11 as showing the handle tapering inwardly ad downwardly from the top to the surfaces 24 and 26.

As seen in FIG. 6, a set (or two) components are magnetically secured to one another on the two sides (outside and inside of the same lower corner of the frame of a screen door, the corner nearest to the door jamb). There they will remain until manually removed (for example, after an event, or preparing for the winter). With the components magnetically connected about the frame of the screen door, as described, when a user desires to open or close the sliding screen door 100, he can easily locate his/her foot or toes on one of the inclined sides 34 or 36 of the component 10 (depending upon whether the user is opening the screen door 100 or closing the screen door). Contact between the toes or foot and the foot contact surfaces 34 or 36 and then moving one's foot, toes or leg in the proper and desired direction will easily cause the component 10 to slide the screen door 100 in the open or closed direction/condition. Placing one's foot on the opposed foot contact surfaces 34 or 36, of the same first component 10, will allow the user to slide the screen door 100 in the opposite direction. And, of course, when the user passes through the open screen door to the other side, he/she can similarly operate the opening and closing of the screen door 100 in the same manner as from the inside just described above. As should be appreciated, the components 10 are magnetically secured to the bottom frame near the corner of the screen door 100 and move together to operate to open and close the screen door 100. When the components and screen door openers/closers are no longer desired or needed, an individual can simply pull on one or both of the handles protruding outwardly to disengage the magnetic coupling. Stated differently, the mechanical and manual force of an adult should easily be able to overcome the magnetic attractive forces of the magnetic bars. Often a twisting motion on one or both of the handles will ease the removal of the components from one another.

The foot/toe contact surfaces, 34 and 36, are inclined to facilitate the contact and movement of the screen door 100 by action of the foot/toes and leg of the user. In an alternate embodiment of the invention, the front or top surface of the handle 7 (the foot contact element 28) can have a central depression or notch within which the user's toe(s) (whether with or without shoes thereon) can fit and rest to slide the screen door 100 open or closed. It is also within the scope of the present invention for the handle or foot/toe contact surfaces to be located on the top surface of the components, I.e., they need not necessarily extend from the front of the components. FIG. 6 shows the contact of the inside of the foot (pinky toes) against the opening side of the component's handle 7 or foot or toe contact surface, i.e., side 34.

FIGS. 7 through 12 of the drawings correspond to those of FIGS. 1-6 with the same numbers corresponding to the same elements. The difference between the embodiment of FIGS. 7-12 and that shown in FIGS. 1-6 resides in the shape of the handle component 7 (also referred to as the foot/toes contact piece.) More specifically, the handles 7 for the components of FIGS. 1-6 show the inclined walls 34 and 36 to broaden toward the base or back of the components 10 while the handles shown in the embodiments of FIGS. 7-12 show the handles 7 and the inclined walls **34*b* and 36*b* narrowing from their top toward the planar surfaces 24 and 26 of the front of the components 10. The difference in the shape of the handles seems to be one of aesthetics but also corresponds with the ease and simplicity of placement and removal of the components—with it being currently understood that the components 10 with the narrowing to the surfaces 24 and 26 (FIG. 11) shape for the handle 7 is seemingly easier to manually, as desired, disengage the bar magnets 70** (and is more comfortable and easier to use for assembly and removal of the components.

The magnets require a significant amount of magnetic strength per unit of weight. These strong magnets can be brittle and thus can shatter if abused. Thus, the present invention provides the protective casing (hard plastic or silicone for example) and materials, e.g., holding the magnets within walls of mating cavities, foam or layers of material, and adhesive to surround the magnets, complete the cavities, etc. Yet, it is important that the magnets be strong enough to hold to one another and not slide on the screen door as the door is moved laterally and that the components 10 cannot be easily pulled off of the doors by children. They should not be small enough either for small children to accidentally swallow the same as the components are at a low floor level, otherwise attained by small children.

Generally, a common screen door is about ½" thick so the magnetic attraction must extend beyond that distance and still hold the two components magnetically to one another and without sliding along the base of the screen door as laterally movement of one component is sought by foot and leg movement. The components each have a base and possibly a layer of foam, usually no more than ¼" on the back. The inventors have determined that a magnetic attraction of about 7 pounds for the ½" screen door thickness or separation is about right for the intended use.

With respect to the hard plastic cases for the bar magnets, described above, a non-permanent, protective adhesive strip, like carpet tape, can be provided to the back of the components, so that the dimensions are thus slightly increased.

For the silicone molded model (shown in FIGS. 13-18) for the magnetic materials, a magnet of about 2" by 1" by ½" seems appropriate with an N52 Neodymium magnetic material designation. The strength of the magnets at ½" of distance (for the thickness of the screen door) is about 5.95 pounds and the strength at ¼" is about 21.89 pounds. In the molded silicone embodiment, the back (which abuts the screen door) is about 4.6" from side to side, the front (which projects outward from the screen door) is about 2.5", in side to side length, with the height of the component and its distance from front to rear being about 1.5". The contained magnet will measure about 2"×1" by ½". The toe groove extending forwardly from the front toward the rear of the components can be about ½" deep and the outwardly extending sides of the component, i.e., the actual foot or toe contact surfaces can be angled outwardly from the front towards the back of the component at about 45 degrees, starting about ¼" or so from the back of the component. An alternate configuration could have the side or foot and toe contacting surfaces slant from the front inwardly towards the back of each component. This might provide a better gripping surface for the foot or toes. The contained magnet is generally located about ¼" from the back of the component so that, with a ½" screen door therebetween, the total distance between opposed magnets is ⅛"+⅛"+½" or a total bar to bar magnetic distance of about ¾".

Figure 13:
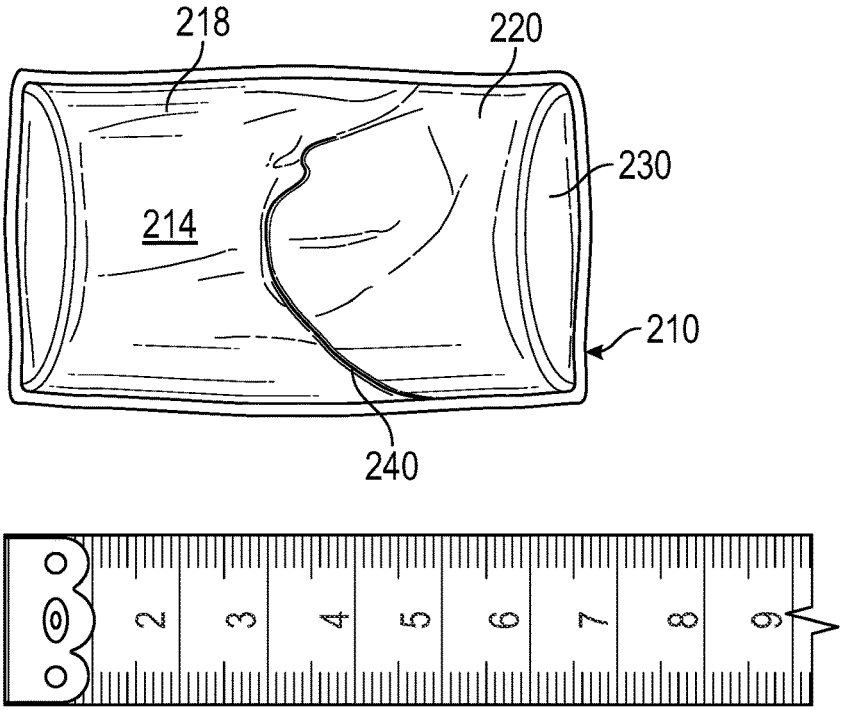
FIG. 13 is a front elevational view of another embodiment of the invention, made of molded silicone with a magnet embedded, along with a scaled portion of a tape measure to show approximate dimensions of the same (the roughness of the exterior of the component being a function of the fact that this drawing figure is based on a prototype which was hand formed—the actual production version should be smooth walled.
Figure 14:
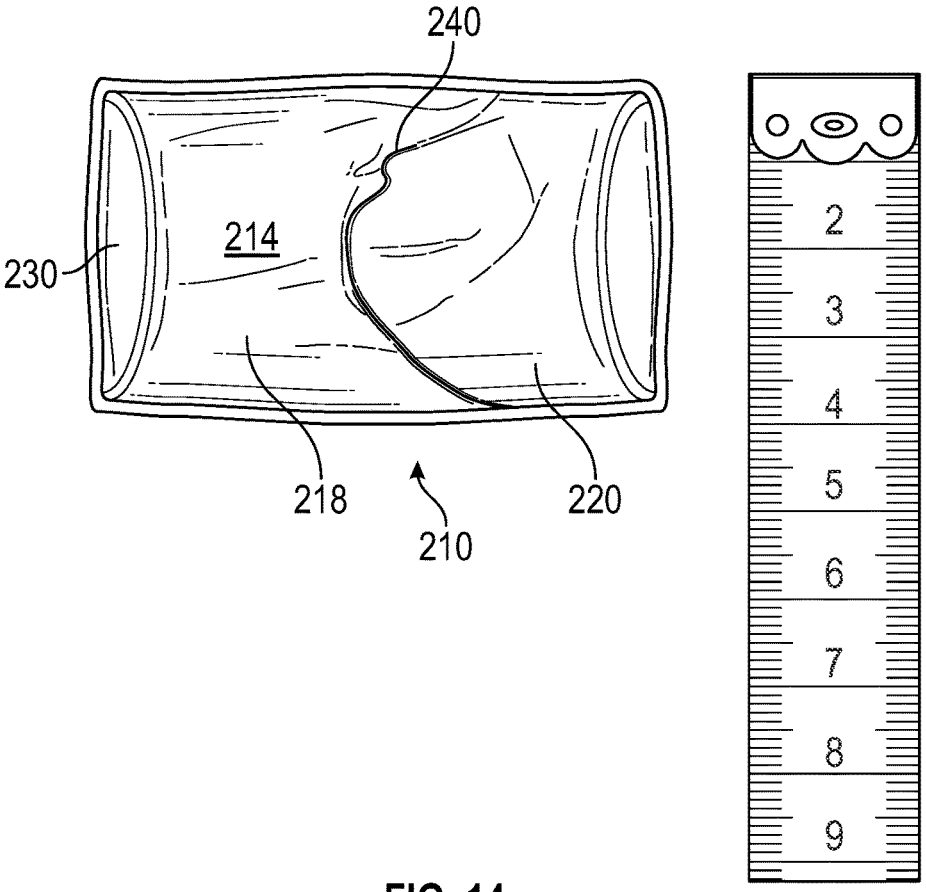
FIG. 14 is another front elevational view of the embodiment shown in FIG. 13 with the scaled tape measure again shown to generally indicate another relative dimension of this component and embodiment of the invention.
Figure 15:
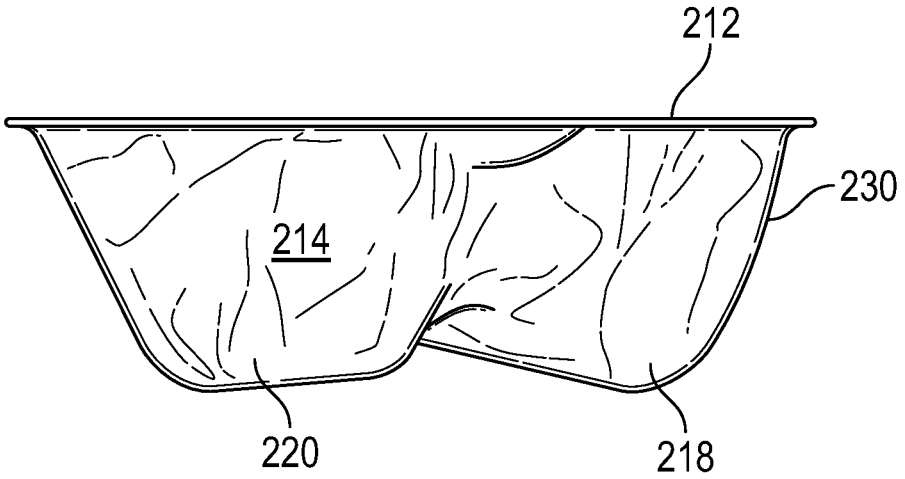
FIG. 15 is a top plan view of the embodiment shown in FIGS. 13 and 14.
Figure 16:
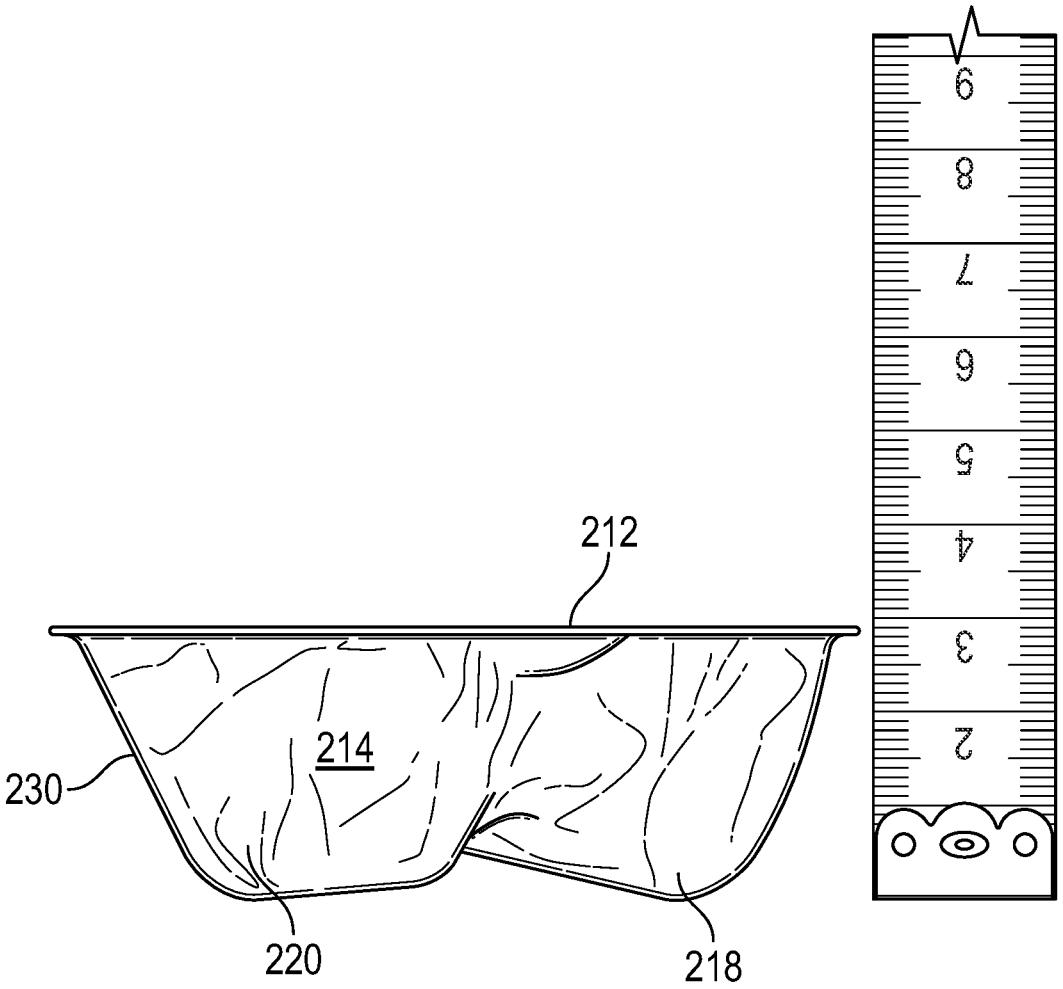
FIG. 16 is another top plan view of the embodiment of the invention shown in FIG. 15, along with a scaled tape measure to show the approximate dimension of the component from front to rear (the rear being securable to the bottom frame near the corner of a screen door)
Figure 17:
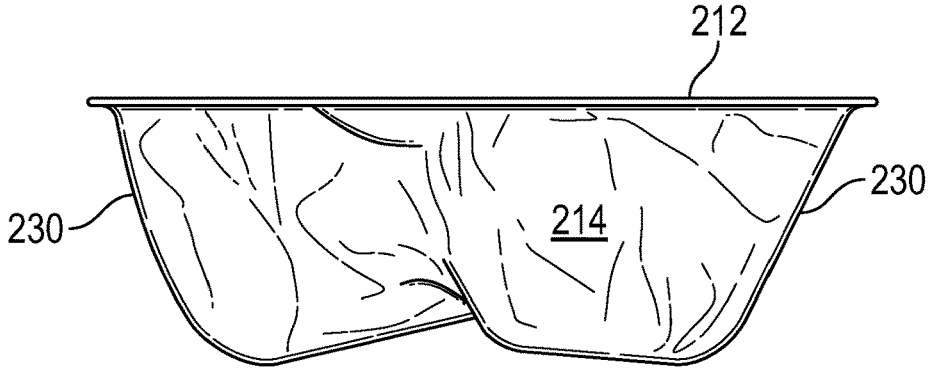
FIG. 17 is a bottom plan view of the embodiment of the invention shown in FIGS. 13-16.

Turning attention to FIG. 13 and on as related to the silicone molded casing for the magnets, it is clear that a flat back or screen door contact surface of about 4.6" is appropriate, a thickness from back of component to its front or foot/toe contact sides of 1.5 inches, and a thickness from the bottom to the top of the components should be about 1.5". The middle toe contact groove (to ease foot and toe contact and thus ease in screen door movement) should be about 0.5" deep and the magnetic bar 70 separated by silicone and/or foam from the location of the wall which abuts the frame should be about ½". In alternate embodiments of the silicone or other versions of the device, the components can be made in different colors, can have LED embedded lights, etc. And, as mentioned, while the FIGS. show surface irregularities, it is intended that the final product be smooth walled. The difference is that the FIGS. Were drawn from the hand-made prototypes and not a final end product.

Figure 18:
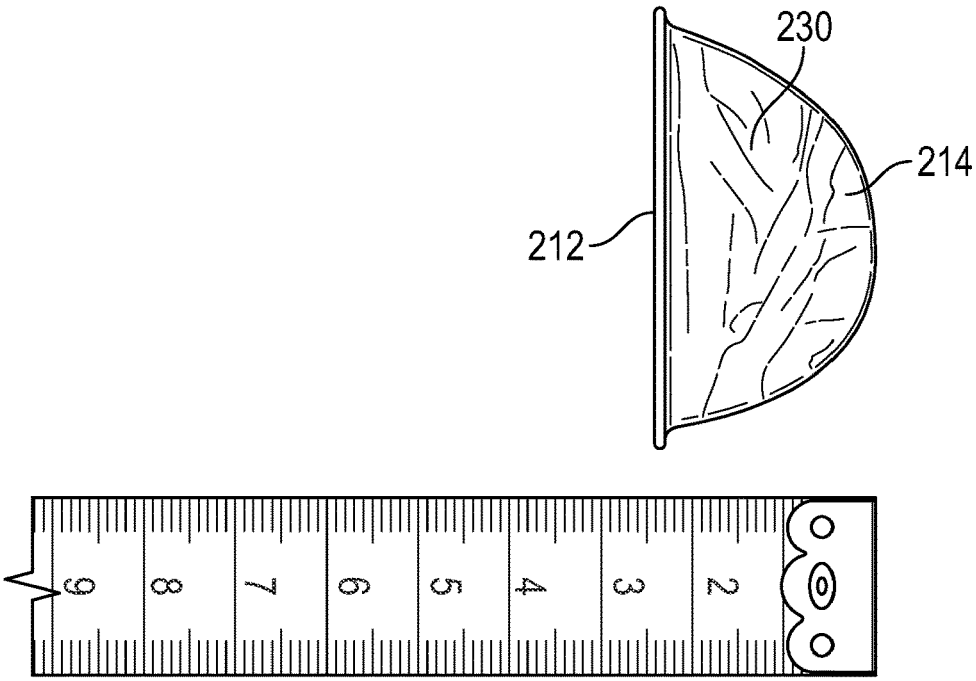
FIG. 18 is a side elevational view of the embodiment of the invention shown in FIGS. 13-17 with a scaled tape measure to show approximate relative dimensions of this component.

In the embodiment shown in FIGS. 13-18, with scaled tape measures adjacent to show possible relative dimensions, a component 210 is shown with a front 214, flat back 212, a pair of upwardly and inwardly sloped side walls 218 and 220, and inwardly curved side walls 230. The curved wall extends from one side to the other and has a central depression or crease 240. The depression is provided to facilitate the easy toe or foot placement to open or close the door. The inwardly sloped walls create a directional force that adds an additional support to the magnetic attachment. The overall shape allows for hand gripping and turning of the component with respect to its opposed and identical component on the other side of the frame of a screen door. The depression is provided with suitably shaped surfaces for conforming to the thumb, forefinger and/or\ palm of a hand so that turning of the same in the clockwise or counterclockwise direction is simple and without real effort. The user can easily overcome the magnetic attraction of the bar magnets of the components to allow for ease of selective removal. FIG. 18 best shows that the component has a flat back where it contacts the frame of the screen door.

Figure 19:
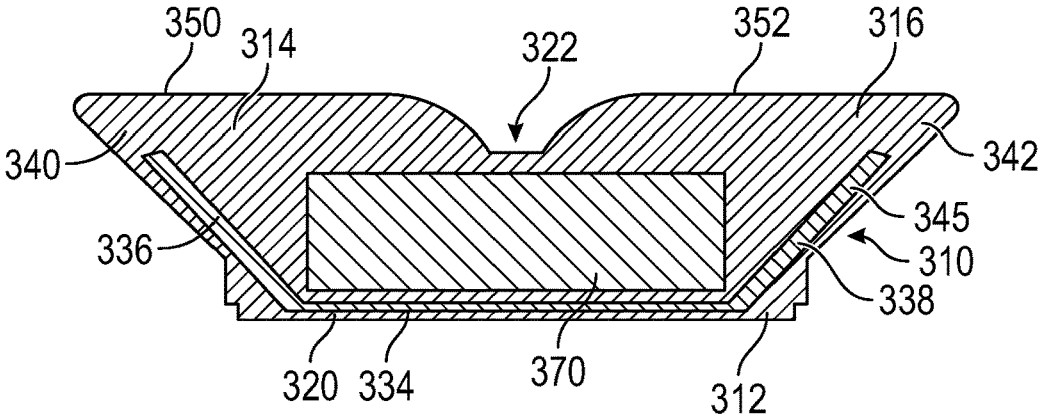
FIG. 19 is a horizontal planar cross-sectional view of another embodiment of a component for the invention.

Another embodiment of the invention is shown in FIG. 19 and it is in the general shape of a flattened "Y," with the back 312 of the component 310 corresponding to the base of the letter Y (and being about 2.5 inches). The back will be the surface to come into contact with the screen door and magnetically secure to another of the components 310. This embodiment can be molded in silicone or hard or durable plastic or other suitable material and surround the interior pieces, i.e., the bar magnet 370 and a stiffener 345. The bar magnet is generally the same type as that previously described, i.e., with a N and S pole to magnetically attract and attach to a second component 310 with its S and N poles with the frame of the screen door therebetween. As the component 310 is in the shape of a Y, the outwardly spreading legs of the Y, 314 and 316, are the foot and/or toe contacting surfaces. These extend outwardly from the back 320 and can be provided with a central notch of the Y, 322. The outside surfaces of the legs 314 and 316 can be easily contacted by foot or toes and when the foot is laterally moved the component will move along with the screen door (but not with respect to the door) and thus slide the door in the same direction as the movement of the foot. A stiffener 345 is molded within the component 310 and serves to support the bar magnet 370 and separate it slightly from the back 320. The stiffener is preferably a piece of hard but resilient plastic. The stiffener 345 is shaped as a channel, extending from top to bottom of the component 310 and has a flat back 334 and a pair of outwardly extending legs 336 and 338. The legs 336 and 338 of the stiffener 345 extend upwardly and outwardly from the flat back 334 and into the sides 340 and 342 of the Y shaped component. The stiffener can be resilient so that pressure brought against the outside of the sidearms 340 and 342 for sliding of the door will, when the foot and/or toes are removed, result in the component reassuming its original shape. As mentioned, a central notch 322 can be located between the front surfaces 350 and 352 and it, too, alternatively, can be contacted by the toes of a foot to facilitate the sliding movement of the door—a consequence of contact between the toes of the foot and the component, held to a screen door. The space or notch 322 between the legs 314 and 316 of the Y form the simple notch 322 at the middle which can serve as toe holds for sliding the door in either of the open or closed direction.

In this embodiment, the front of the component will be about 4.6 inches in width, with the notch in the middle of the Y being about ½ inch wide and extending about ½ inch in depth from the front of the component 310. The top to bottom surfaces of the component 310 will be about 1.5 inches. The outside legs 340 and 342 of the Y of the component 310 extend at an angle of about 45 degrees to the back 320. A protective thin layer of material can be secured to the back 320. In this embodiment, an N52 Neodymium bar magnet 370 is embedded into the Y component and its dimensions are about 2 inches by ½ inch by ½ inch.

In yet another embodiment of the present invention, a silicone body for the components will resemble the shape of the letter "M (not a "Y"). Here, the shape of the "M" component (preferably made of molded silicone, is considered superior as pressure from the toe on either side of the M component pushes towards the door. In contrast, with the "Y" shaped silicone embodiment, side pressure on the legs of the "Y" shaped component, during attempted lateral movement of the screen door, tends to pull the component away from the frame of the door. That could (and seemingly does) tend to tip and disconnect the component from the frame. the "M" shape is considered preferable to the "Y" shape for the silicone molded version.

The invention claimed is:

1. A pair of components for a sliding door each component containing and comprising a magnet which, when each of the components are assembled on opposed sides of a bottom frame near a corner of the sliding door, attract and magnetically hold to one another through the sliding door, each component having a pair of opposed, laterally directed, foot-contacting surfaces to facilitate the lateral sliding of the door in a direction of a user's foot movement, so as to selectively open or close the sliding door, each of the components comprises a flat back, a pair of upwardly and inwardly sloped side walls, inwardly curved side walls, and a central depression in the curved side walls, and wherein each of the magnets is embedded in the respective component.

2. The pair of components as claimed in claim 1 made of molded silicone.

3. The pair of components as claimed in claim 1 wherein each magnet is protectively encased within the respective component.

4. The pair of components as claimed in claim 1 wherein the magnets are sufficiently strong to hold to one another across a centrally located, non-ferrous slidable screen door of about ½ inch in thickness.

5. The pair of components as claimed in claim 1 wherein the magnets couple to one another with a strength of at least 4 pounds of magnetic force across a thickness of the sliding door of about ½ an inch.

6. The pair of components as claimed in claim 1 wherein an outside surface of each of said components is formed to accommodate a thumb, a palm or fingers of a hand to facilitate turning of one of said pair of components with respect to the other of said pair of components.

* * * * *